United States Patent [19]

Johnson

[11] Patent Number: 4,745,838

[45] Date of Patent: May 24, 1988

[54] REED HOLDING DEVICE FOR MUSICAL INSTRUMENTS

[76] Inventor: Conrad O. Johnson, 2414 Rosewood, Houston, Tex. 77004

[21] Appl. No.: 29,136

[22] Filed: Mar. 23, 1987

[51] Int. Cl.[4] ..... G10D 9/02

[52] U.S. Cl. ..... 84/383 R

[58] Field of Search ..... 84/383

[56] References Cited

U.S. PATENT DOCUMENTS 1,801,421 4/1931 Gemeinhardt ..... 84/383 B
2,648,246 9/1953 Mueller ..... 84/383 B
3,618,440 11/1971 Ratterree ..... 84/383 B
4,210,055 7/1980 Platamone ..... 84/383 B

*Primary Examiner*—Lawrence R. Franklin
*Attorney, Agent, or Firm*—Marett & Marett

[57] ABSTRACT

A reed holding device for the mouthpiece of a musical instrument in which a single unitary strip extends around the mouthpiece having an integral separate bottom plate attached thereto with raised shoulders supporting the reed. The edges of the reed rest on the raised shoulders of the bottom plate avoiding direct contact with the single unitary strip.

5 Claims, 1 Drawing Sheet

REED HOLDING DEVICE FOR MUSICAL INSTRUMENTS

BACKGROUND OF THE INVENTON

1. Field of the Invention

This invention relates to mechanical reed musical instruments and more particularly to a device for supporting a reed relative to the mouthpiece of the instrument.

2. Description of the Prior Art

In a typical reed musical instrument, energy in the form of an air stream is converted to acoustical energy by virtue of the air stream being throttle by an air actuated vibrating reed. In the design of these type instruments, it has long been recognized that the effects of vibrating reeds are important in tone production. The manner in which the reed is clamped relative to the mouthpiece significantly modifies the reed behaviour. It is known that if the reed is allowed to vibrate more freely, then a fuller, darker, richer and mellower sound is produced and the extreme upper and lower registers of woodwind instruments are easier to play in. In this context, the construction and arrangement of these devices for securing the reed relative to the mouthpiece of the instrument, known as ligatures, is extremely important since it is an integral part of the vibrating system. Representative patents in the general area of this invention are U.S. Pat. Nos. 1,060,946 (clarinet); 2,837,003 (mouthpiece and ligature for reed instruments); 3,618,440 (ligature for single reed woodwind musical instrument); 4,056,997 (reed holding device for musical instruments); 4,185,535 (reed holding device); and 4,275,636 (ties for the mouthpiece of a wind instrument).

While the various devices as discussed above, or variations of them, have been used extensively for attaching a vibrating reed to the mouthpiece of a musical instrument, they each have serious drawbacks as represented by the advancement of the art. Each patent recognizes the need to allow the reed to vibrate more freely. However, none of the foregoing patents disclose the device of the present invention wherein the reed is supported in a special manner within the ligature to allow this freedom of vibration.

SUMMARY OF THE INVENTION

The present invention provides a new and improved ligature for holding the reed onto the mouthpiece of a musical instrument in such a way as to allow the reed to vibrate more freely not heretofore produced by the prior art.

In accordance with the invention described herein, there is provided a single unitary strip of material adapted to extend around the body of the mouthpiece and the reed having an internal bottom plate positioned within the ligature having raised shoulders to support the longitudinal edges of the reed thus preventing the reed itself from being in direct contact with the body of the ligature. There is disposed along the edges of the internal bottom plate a series of opposed resonant slots to further help in freeing up the vibration of the reed.

BRIEF DESCRIPTION OF THE DRAWINGS

The invention will be hereinafter more fully described with reference to the accompanying drawings which include.

DESCRIPTION OF THE PREFERRED EMBODIMENT

Figure 1:
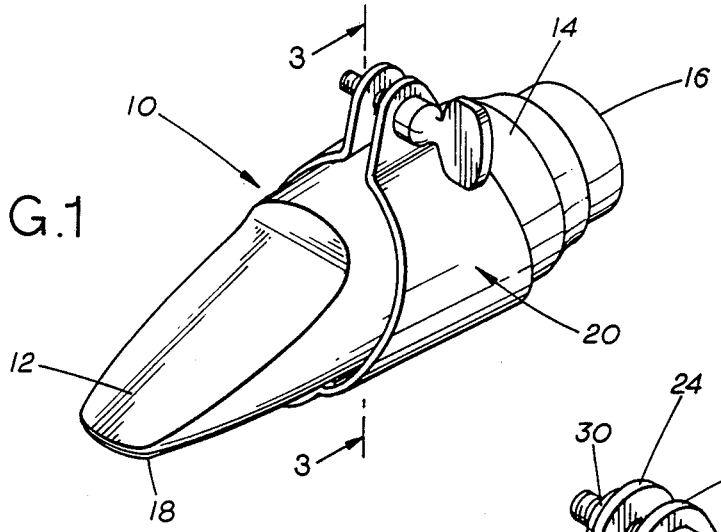
FIG. 1 is a perspective view depicting the reed holding device of the present invention shown installed on a mouthpiece holding a reed in proper operating position relative to the mouthpiece.

Referring to FIG. 1 of the drawings, reference numeral 10 refers in general to a mouthpiece of a typical reed musical instrument. The mouthpiece 10 is of a generally cylindrical shape having a tapered front portion 12, a slightly tapered main body portion 14 and a tapered, reduced rear end portion 16 which is adapted to fit to the instrument in a conventional manner. A reed 18 extends over the flat lower surface of the main body 14 of the mouthpiece 10 and held to the mouthpiece 10 by the device of the present invention shown in general by the reference numeral 20.

Figure 2:
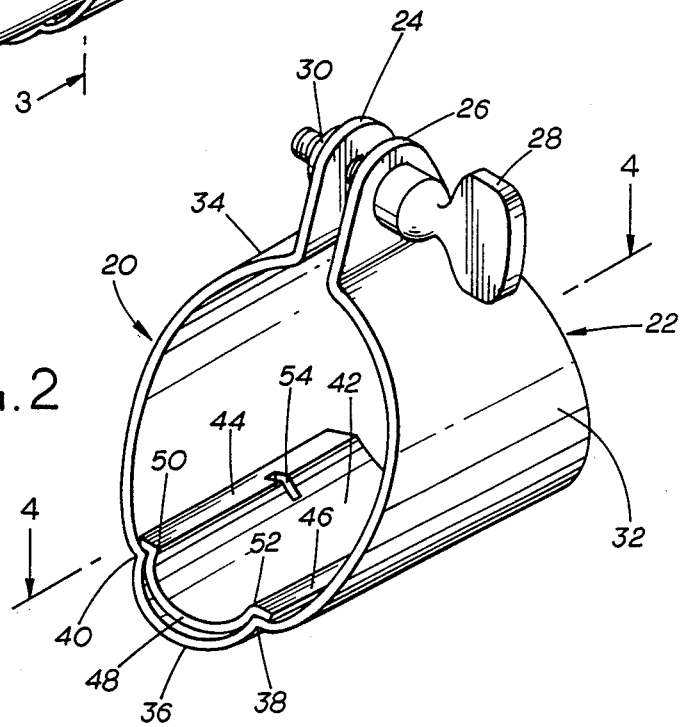
FIG. 2 is an isometric view of the present invention.
Figure 3:
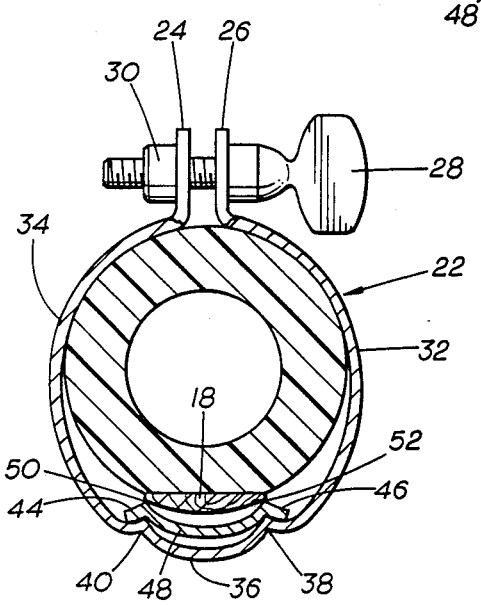
FIG. 3 is a cross-sectional view taking along lines 3—3 of FIG. 1 showing the reed being supported on the raised shoulders of the bottom plate.

Referring now to FIGS. 2 and 3, the device of the present invention is shown in general by the reference numeral 20 and includes a strip 22 of material having two end portions 24 and 26 held together by bolt 28 and nut 30. Strip 22 comprises a first side portion 32, a second side portion 34, and a bottom concave portion 36 so joined together so as to produce a first shoulder 38 and a second shoulder 40. A bottom plate 42 is disposed within said strip 22 and comprises a left side member 44, a right side member 46 and a concave bottom member 48 so arranged together such that a third shoulder 50 is produced where the left side member 44 joins the concave bottom member 48 and a fourth shoulder 52 is produced where the right side member 46 joins the concave bottom member 48. The bottom plate 42 is positioned within said strip 22 and over the bottom concave portion 36 such that first shoulder 38 is aligned with the fourth shoulder 52 and the second shoulder 40 is aligned with the third shoulder 50.

Figure 4:
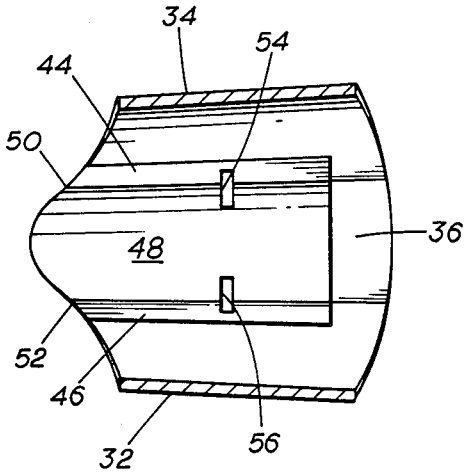
FIG. 4 is a sectional view taken along lines 4—4 of FIG. 2.

Referring to FIGS. 2 and 4, there is illustrated a first slot 54 within the left side member 44 and extended into the concave bottom member 48 and an opposing slot 56 extending into right side member 46 and also into the concave bottom member 48. While FIG. 4 illustrates one pair of opposing slots 54 and 56, it is anticipated that the present invention could comprise a plurality of opposing slots along the left side member 44 and right side member 46 extending down into the concave bottom member 48.

FIG. 3 illustrtes how the reed 18 is supported by the bottom plate 42 at only two points of minimum contact, that being the third shoulder 50 and the fourth shoulder 52 along the edges of the reed 18. This prevents the ligature strip 22 from being in direct contact with the reed 18 and allows the reed to vibrate more freely by only being supported at its outer edges.

Thus, a new, novel and unobvious ligature has been described not heretofore produced by the prior art which incorporates the combination of an internal bottom plate supporting the reed on raised shoulders along the edges of the reed itself. While the invention has been described with reference to a preferred embodiment, it would be obvious to one skilled in the art that modifications and variations of the invention may be constructed and employed without departing from the scope of the invention. The scope of the invention is defined in the following claims.

I claim:

1. A reed holding device for holding a reed on a mouthpiece of a musical instrument comprising:

a single strip of material extending around the outer portions of said reed and said mouthpiece having a first end portion and a second end portion and a first concave side portion, a second concave side portion, and a concave bottom portion wherein said first concave side portion communicates with said concave bottom portion in such a way as to form a first shoulder and said second concave side portion communicates with said concave bottom portion in such a way as to form a second shoulder;

a bottom plate having a left side member, a right side member and a concave bottom member wherein said left side member communicates with said concave bottom member in such a way as to form a third shoulder and said right side member communicates with said concave bottom member in such a way as to form a fourth shoulder, said bottom plate being positioned within said strip such that said first shoulder fits on said fourth shoulder and said second shoulder fits on said third shoulder and said reed is held against said mouthpiece by said third and fourth shoulders at the edges of said reed;

fastening means for securely fastening said strip in engagement with said reed and said mouthpiece to secure said reed to said mouthpiece.

2. The device of claim 1 wherein said first end portion and said second end portion of said strip extend in a spaced relationship and wherein said fastening means cooperates with said end portions.

3. The device of claim 2 wherein said fastening means comprises a connecting bolt and nut positioned through said end portions.

4. The device of claim 1 wherein said concave bottom plate further comprises a plurality of slots positioned along said first edge end and a plurality of opposing slots positioned along said second edge end.

5. The device of claim 4 wherein said strip further comprises a first end portion and a second end portion which extend in spaced relationship with each other wherein said fastening means cooperates with said first end portion and said second end portion to hold said strip and said reed to said mouthpiece.

* * * * *